US007506696B2

(12) United States Patent
Weston et al.

(10) Patent No.: US 7,506,696 B2
(45) Date of Patent: Mar. 24, 2009

(54) BOREHOLE DRILLING CONTROL SYSTEM, METHOD AND APPARATUS

(75) Inventors: John L. Weston, Somerset (GB); David P. McRobbie, Aberdeen (GB)

(73) Assignee: Halliburton Energy Services, Inc., Houston, TX (US)

( * ) Notice: Subject to any disclaimer, the term of this patent is extended or adjusted under 35 U.S.C. 154(b) by 297 days.

(21) Appl. No.: 10/980,645

(22) Filed: Nov. 3, 2004

(65) Prior Publication Data

US 2006/0006000 A1 Jan. 12, 2006

(51) Int. Cl.
*E21B 47/024* (2006.01)
*E21B 7/06* (2006.01)

(52) U.S. Cl. ..... 175/45; 175/61; 175/73

(58) Field of Classification Search ..... 175/45, 175/62, 73, 61
See application file for complete search history.

(56) References Cited

U.S. PATENT DOCUMENTS 3,743,034 A * 7/1973 Bradley ..... 175/61
6,714,870 B1 * 3/2004 Weston et al. ..... 702/9
2005/0061549 A1 * 3/2005 Evans et al. ..... 175/62
2007/0187147 A1 8/2007 Weston et al.

FOREIGN PATENT DOCUMENTS

WO WO 01/29372 A1 4/2001

OTHER PUBLICATIONS

"Non-Final Office Action mailed Jul. 6, 2007 in U.S. Appl. No. 11/787,516, 9 pgs", 9.
"U.S. Appl. No. 11/787,516, Non Final Office Action mailed Jul. 6, 2007", 9 pgs.
"U.S. Appl. No. 11/787,516, Non-Final Office Action mailed Apr. 9, 2008", OARN, 11 pgs.
"U.S. Appl. No. 11/787,516, Response filed Jan. 7, 2008 to Non Final Office Action mailed Jul. 6, 2007", 10 pgs.

* cited by examiner

*Primary Examiner*—Giovanna C Wright
(74) *Attorney, Agent, or Firm*—Schwegman, Lundberg & Woessner, P.A.

(57) ABSTRACT

One embodiment includes an apparatus comprising a steerable well bore drilling tool having a main tool body. The steerable well bore drilling tool includes an inertial measurement unit to output a measurement used to determine an azimuthal deviation and inclination of the steerable well bore drilling tool during a drilling operation.

52 Claims, 6 Drawing Sheets

BOREHOLE DRILLING CONTROL SYSTEM, METHOD AND APPARATUS

RELATED APPLICATIONS

This application claims priority to United Kingdom Application Serial No.: 0415453.0, filed on Jul. 9, 2004, which application is incorporated herein by reference.

TECHNICAL FIELD

The application relates generally to drilling. In particular, the application relates to closed loop control of a steerable drilling tool during the drilling of a borehole.

BACKGROUND

Rotary steerable tools are one example of drilling tools used in the oil, gas and civil engineering industries to drill bore holes. Such tools are typically located between the drill bit and the drill pipe. While a rotary steerable tool may vary in principle, it will generally comprise of a bias or steering unit which exerts a force, either internally on a flexible central shaft or externally on the borehole wall to affect a change in the steering geometry to the desired direction. In one configuration, the drill pipe is connected to a drive unit located at the surface and transmits the rotary motion of the drive unit via the rotary steerable tool to the drill bit. The rotary steerable tool comprises a flexible central shaft which is connected at its top end via the necessary connections to the drill pipe. The bottom end of the flexible shaft is similarly connected to the drill bit. The flexible shaft is supported by two bearing systems, one at either end. The upper bearing is designed to prevent bending of the shaft above it and the lower bearing is typically of the angular contact type and thus allows movement of the shaft above and below it. Between the two bearings, around the centre of the length of the flexible shaft, is a bend unit that deflects the shaft. Various mechanisms may be implemented to cause the flexible shaft to be deflected to the designated amplitude so as to cause the correct angular deflection of the shaft in the required direction. It will be apparent that the portion of the flexible shaft located below the angular contact bearing will move in the contra-direction to the portion of the flexible shaft located immediately above the bearing in the bend unit. Other rotary steerable designs exist which generate deflection by alternative methods; for example, eccentric pressure pad application.

Rotary steerable tools typically incorporate a reference stabilized housing which is de-coupled, either actively or passively, from the drill string. For example, the outer housing may be restrained from rotating with respect the drill hole walls by a reference stabilizer located along the outer housing. The stabilizer typically has three or four sets of sprung rollers or contact pads which may accommodate over-gauge hole sections. The outer stabilized housing may in fact rotate in the same sense as the drill bit, but at a very slow rate as the system progresses down the hole. The reference stabilizer is designed and operated to ensure that the ratio of drill bit to outer housing turn rate does not exceed a fixed limit.

It can therefore be appreciated that as the drill bit and rotary steerable tool progress downwards along the drilled bore hole, the trajectory of the assembly, and hence that of the borehole, can be controlled. This control is typically performed and supervised by a drilling operator at the surface or start location of the bore hole.

Typically, a conventional Measurement While Drilling (MWD) survey tool is located above the rotary steerable tool in the Bottom Hole Assembly (BHA). BHA is the term used to refer to the units components and instruments positioned at the bottom of the drill string. The BHA does not necessarily include the drilling tool itself and in the present application the term BHA is used to refer to the units components and instruments placed between the drilling tool and the drill string.

Such a MWD survey tool comprises magnetometers and inclinometers which provide the drilling operators respectively with azimuthal deviation data (from a reference, e.g. magnetic north) and inclination measurements relating to the portion of bore hole in which the MWD survey tool and the BHA are currently located. When taken together these measurements provide information concerning the trajectory of the bore hole. Typically, the distance of the MWD survey tool from the surface, i.e. the well bore path length, is derived from the length of drill pipe which has been inserted into the well bore behind the MWD survey tool. Thus, the drilling operators are provided with the attitude (azimuth direction and inclination) of the bore hole at a given bore hole length. This information can be used by the drilling operators to guide the rotary steerable drilling tool.

However, there are various problems with the accuracy and latent reaction time of such a set-up. Firstly, given that the rotary steerable tool can be more than 18 feet long, the conventional MWD survey tool is located a considerable distance from the drill bit. Thus, if the drill bit veers off the desired trajectory (for example owing to rock mechanics) the drilling operator remains unaware of this condition until the MWD survey tool reaches the point at, or beyond which the unplanned deviation occurred. At this time the drill bit has progressed considerably along the deflected trajectory. Only at this point is the drilling operator aware that corrective action may be necessary.

Secondly, as MWD survey tools are typically located within the BHA at the lower end of the drill string. While drilling is in progress, the MWD survey tool is subjected to a high degree of vibration and rotary forces. This makes it difficult to obtain accurate survey data while drilling is in progress. Thus, in typical well bore drilling set-ups, drilling is stopped from time to time in order that accurate surveys may be undertaken; normally at pipe connections.

Thirdly, the drill string is typically made up of multiple segments of drill pipe with the BHA located at the lower end. The BHA also comprises tubular components of variable cross section, diameter and length. Both the drill string and BHA are limber in nature which enables the drill string to progress along the large radius curves of the drilled bore hole.

The BHA is normally composed of larger diameter, thicker walled, components, and is less limber than the drill string. In most, but not all, drilling applications, the BHA is stabilized and is nominally held concentric to the central axis of the bore hole. The standard MWD direction tool is in turn centralized within the BHA, thus providing sensor attitude data which can be said to represent the local bore hole axis, but not necessarily that of the newly drilled hole some distance below or ahead of the MWD tool.

The inherent flexibility of the BHA, and specifically, its connection to the rotary steerable system, is a necessary design attribute enabling the steering system to operate quasi-independently of the reaction forces of the BHA above. Hence, the rotary steerable system can be used to deflect the path of the bore hole in any desired attitude and direction.

The above problems could be addressed by positioning the survey sensors on the rotary steerable tool. If the survey sensors were fixed to the rotary steerable tool the measurements provided could be directly mapped to the actual direction of the rotary steerable tool hole section. As the spatial relationship between the drill bit and the rest of the rotary steerable tool will be known, the measurements taken by these sensors can also be mapped to the actual direction of the drill bit. Thus, the problems associated with the positioning of the MWD survey tool further up the drill string may be reduced and preferably eliminated.

However, in general rotary steerable tools are constructed using magnetically permeable materials. As conventional MWD survey tools contain magnetometers, they can not function accurately within the rotary steerable tool itself. Even if non-magnetic materials were used in the construction of the rotary steerable tool, the presence of large diameter steel rotating bodies can result in induced electromagnetic forces generating variable, unstable magnetic fields which preclude the use of magnetometers.

This problem is partially resolved by the use of At Bit Inclination (ABI) sensors (accelerometers) which are located within the outer housing of the rotary steerable tool itself. Such sensors are typically within a few feet of the drill bit and can thus detect relatively quickly any undesired changes in bore hole inclination at or immediately behind the drill bit trajectory and the bore hole axis. However, this sensor configuration does not provide actual azimuthal change. For example, if the drill bit veers from the desired azimuthal trajectory, but maintains the desired inclination, the operator would not be aware of this condition until the MWD survey tool data becomes available for the relevant section of hole. Additionally, the bore hole, at drill bit depth, would have strayed further from the intended trajectory.

Thus, it can be seen that present survey tool systems do not provide an accurate means for detecting the actual direction of the drill bit. This causes problems for the drilling operator when deciding to instruct a change of direction for either pre-planned or error correction reasons. In addition, knowledge of the actual position (i.e. coordinate based reference) of the drill bit, as opposed to just its direction in space, would bring additional real-time accuracy to bore hole drilling.

Another problem with existing systems is that they do not provide the drilling operator with reference quality continuous data from the survey sensors. Generally, the inhospitable environment in which the sensors may be required to operate during the drilling process precludes the availability and recording of accurate data. Thus, reference quality data is typically only obtained when drilling is interrupted and the sensors and BHA are stationary.

In view of the above problems, the provision of automated guidance of the drill bit using closed loop control is not practical in the systems outlined above. The lack of continuous, accurate information concerning the direction of the drill bit, or reference quality positional information, means that drilling operator intervention is required in order to maintain the drill bit trajectory along the pre-planned well path.

SUMMARY

Some embodiments of the invention may provide a steerable bore hole drilling tool comprising a main tool body having a first end connectable to a drill string and a second end connectable to a drill bit. The tool body is arranged to transmit rotary motion from said first end to said second end. The tool body comprises deflection means arranged to deflect said second end away from a longitudinal axis of the main tool body. The tool body also includes an inertial measurement unit and estimation means arranged to first estimate the direction of the main body on the basis of the output of said inertial measurement unit. The drilling tool further comprises control means first arranged to calculate the difference between the estimated direction and corresponding pre-stored direction information and second arranged to control said deflection means so as to deflect said second end on the basis of said difference.

The Inertial Measurement Unit (IMU) may not contain magnetometers, and is thus not susceptible to magnetic interference. This being the case, it can be located on the rotary steerable tool. By positioning the IMU on the rotary steerable tool, the relationship between the longitudinal axis of the IMU and the longitudinal axis of the rotary steerable will be known. Indeed in some embodiments, the axes may be the same. Thus the relationship between the measurements taken by the IMU and the direction and/or position of the rotary steerable tool may also be known enabling accurate determination of the direction and/or position of the rotary steerable drilling tool (and thus the drill bit). In addition, by placing the IMU on the rotary steerable tool, it is located closer to the drill bit than would be the case if it were placed in the BHA (as is the case for conventional MWD survey tools) above the rotary steerable system.

Thus, if the rotary steerable tool is caused to move away from the desired trajectory, by for example, rock mechanics, the IMU will be able to provide immediate indication of this. The vibratory forces experienced by the IMU when positioned on the rotary steerable tool are considerably lower than would be experienced by the IMU if placed in the BHA; above the rotary steerable tool. Thus, the IMU is able to provide accurate measurements when drilling is in progress.

In some embodiments, the main body of the rotary steerable drilling tool further comprises a flexible shaft, positioned within the main body, and a non-flexible shaft, positioned between the first end of the main body and the flexible shaft, wherein the IMU is positioned within the non-flexible shaft.

The main body of the rotary steerable tool may further comprise a rotationally stable platform positioned within the non-flexible shaft, wherein the IMU is positioned on the rotating platform. The stable platform may be arranged to rotate in the contra direction in which the drill string and shafts of the rotary steerable tool are rotating. Thus, the IMU may be kept substantially stationary with respect to the fixed Earth axis. A suitable rotary platform is described in PCT/GB00/02097, filed Jun. 1, 2000, and published in English on Apr. 26, 2001 as WO 01/29372 A1, which is hereby incorporated by reference.

In some embodiments the main tool body may further comprise an outer housing and the inertial measurement unit may be positioned within the outer housing. The outer housing of the rotary steerable tool may be stabilized and remain nominally static for much of the drilling process, turning only slowly as drilling progresses. For example, the rotary motion may be restrained by contact between a reference stabilizer, located along the outer body of the rotary steerable tool and the wall of the bore hole. In addition, this continuous contact with the wall results in much of the shock and vibration being attenuated significantly, in comparison to the levels of motion that may normally be experienced by down-hole equipment while drilling is taking place. Hence, the levels of shock and vibration experienced by the inertial sensors are much attenuated which enables meaningful measurements to be obtained continuously throughout the drilling process.

In some embodiments, the inertial measurement unit (IMU) may comprise gyroscopic sensors together with accelerometers which measure angular rate and linear acceleration respectively. The IMU may comprise orthogonal triads of linear accelerometers and gyroscopes.

In some embodiments, the rotary steerable tool may further comprise a signal processor, which together with the IMU constitutes an inertial measurement system. This system may be configured either as an attitude and heading reference system to provide directional survey data, or as a full inertial navigation system (INS) in order to provide both directional and positional survey data.

The provision of continuous, accurate information concerning the direction and/or position of the rotary steerable drilling tool and/or drill bit by the use of an inertial measurement system enables the implementation of an automated guidance system using closed loop control. The computational capability necessary to implement such a system may be located either at the surface or within the bottom hole assembly. Depth and/or bore-hole path length information may be transmitted from the surface and combined with the inertial measurements concerning inclination and azimuth. This data may then be compared with a pre-planned trajectory. The pre-planned trajectory may be expressed in angular form as a function of path length or as positional coordinates. The computational system may then provide the bend unit or steering system with instructions to maintain the drill bit within the path limits of the pre-planned trajectory.

BRIEF DESCRIPTION OF THE DRAWINGS

Embodiments of the invention may be best understood by referring to the following description and accompanying drawings which illustrate such embodiments. In the drawings.

DETAILED DESCRIPTION

Figure 1A:
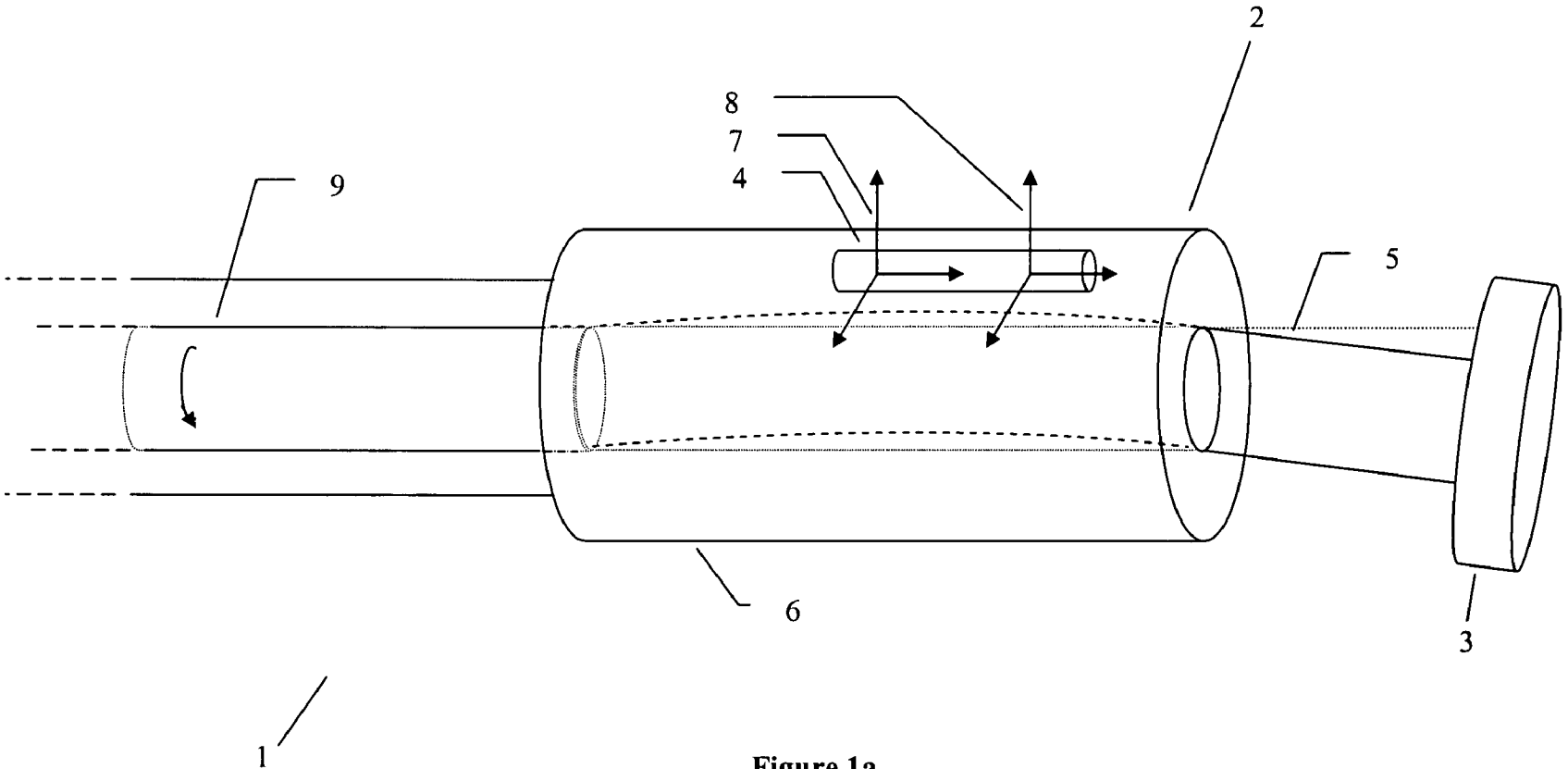
FIGS. 1*a* and 1*b* are schematic representations of the well-bore guidance system, according to some embodiments of the invention.
Figure 1B:
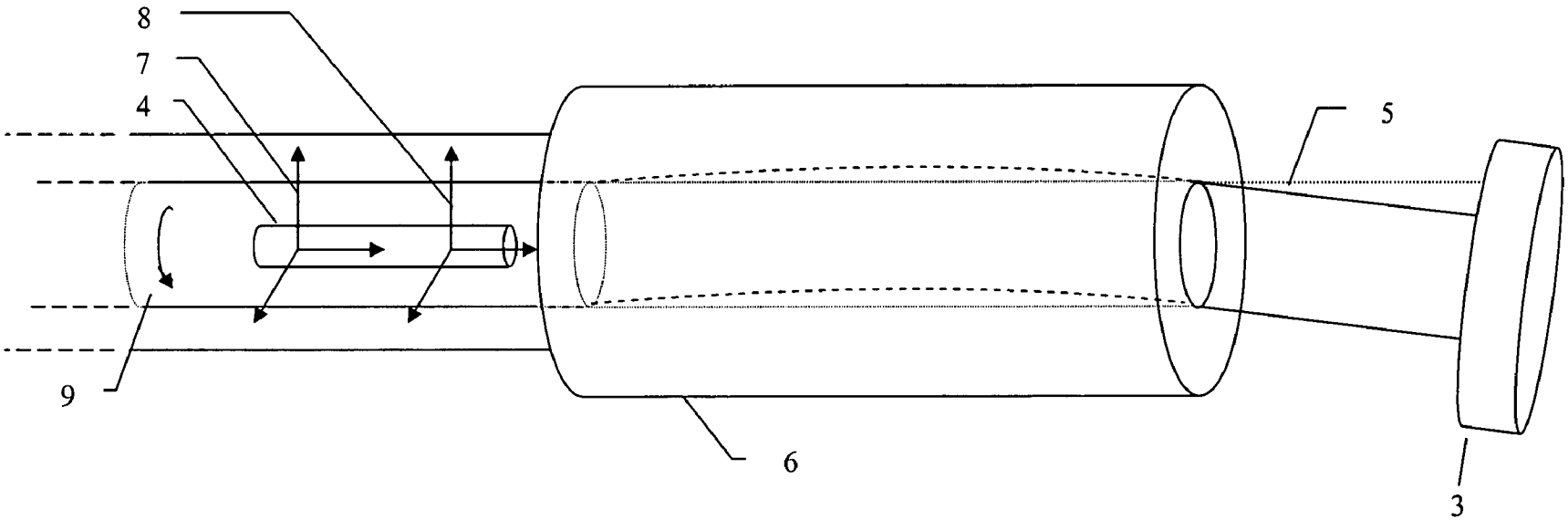

FIGS. 1*a* and 1*b* are schematic representations of the well-bore guidance system, according to some embodiments of the invention. In particular, FIGS. 1*a* and 1*b* show a rotary steerable tool 1 connected to a drill bit 3, according to some embodiments of the invention. Like features are referenced with like numerals. The rotary steerable tool comprises an inertial measurement unit (IMU) 4, a flexible shaft 5 and an outer housing 6. The IMU may provide measurements of acceleration and angular rate about three orthogonal acceleration axes 7 and three orthogonal gyro axes 8 respectively.

A computer (not shown) may calculate on the basis of these measurements, the direction, i.e. inclination and azimuthal deviation, and/or the position of the IMU. The computer may also calculate the velocity of the IMU. Given that the spatial relationship between the IMU and the drill bit is known, the calculations of spatial position and velocity may be extrapolated to provide a measure of drill bit direction, position and velocity. The tool face deflection angle may also be calculated. The IMU and computer together form an inertial measurement system. This system may be configured either as an attitude and heading reference system to provide directional survey data, or as a full inertial navigation system (INS) in order to provide both directional and positional survey data. The direction and/or position of the drill bit may be calculated with respect to a pre-determined reference frame. In addition, the computer may be provided with depth/well bore hole path length information. In full inertial navigation mode, depth information may be used to obtain accurate co-ordinate position data. By combining the inertial system data with independent depth measurements, it is possible to bound the growth of inertial system error propagation.

In FIG. 1*b*, the IMU is positioned in the rotating shaft 9 at the up-hole end of the rotary steerable drilling tool. In FIG. 1*a*, the IMU is positioned in the outer housing of the rotary steerable drilling tool; the non- or slowly-rotating section.

Figure 4:
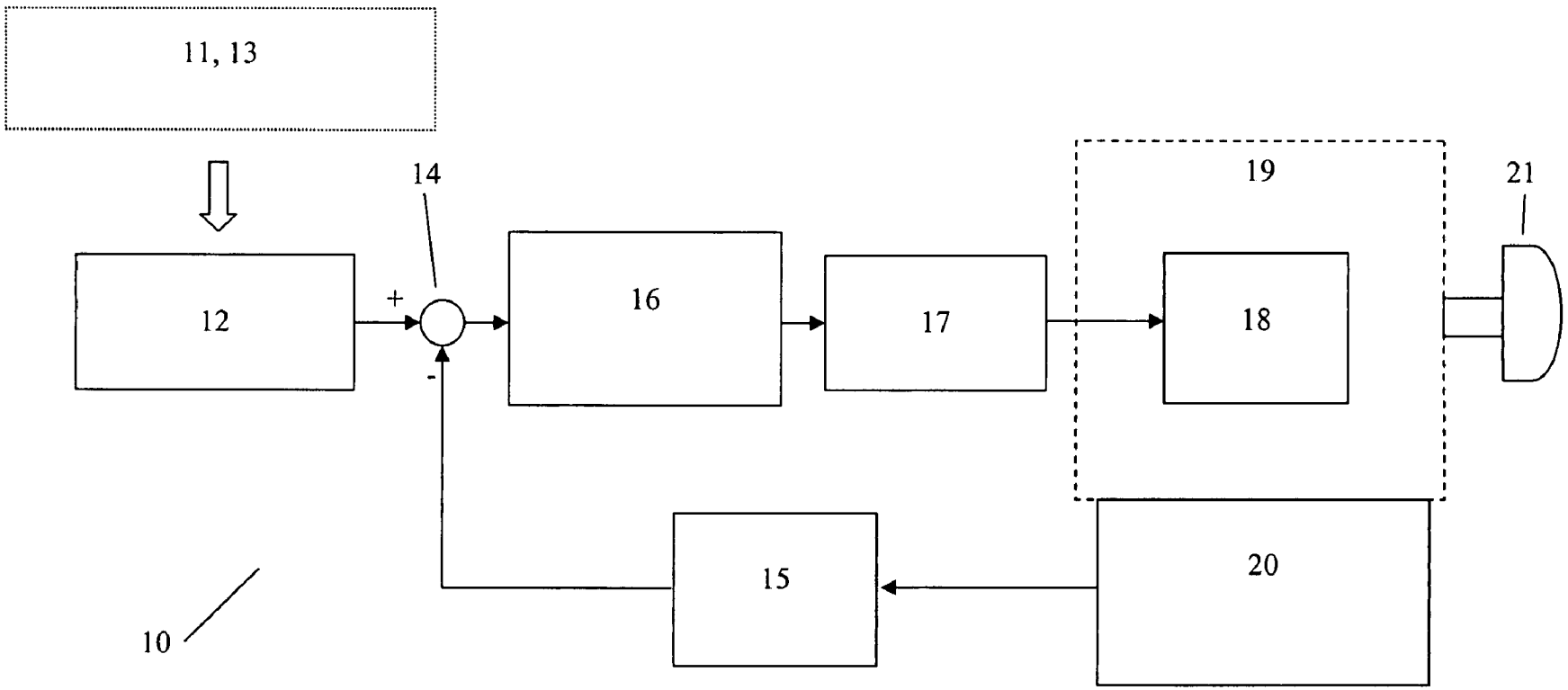
FIG. 4 shows how steering commands are generated in a down-hole closed loop control system, according to some embodiments of the invention.

FIG. 4 shows how steering commands are generated in a down-hole closed loop control system, according to some embodiments of the invention. In particular, FIG. 4 shows the down-hole closed loop control system 10, according to some embodiments of the invention. Initial surface input data 11, which comprise start co-ordinates and planned bore-hole trajectory, may be input into target position means 12 together with continuous measured bore path length updates 13 (surface to rotary steerable system). The target position means may generate target direction and/or position information as a function of bore hole path length. This information may then be input into a difference means 14 together with INS direction and/or position estimate information from the INS 15. The difference between the planned direction and/or position and actual direction and/or position may then be input into well bore axes resolution means 16. The well bore axes resolution means may then resolve the direction and/or position differences into well bore axes. This information may then be fed into steering command generation means 17, which generates steering commands to pass to the rotary steerable tool bend unit 18 in the rotary steerable tool 19. The rotary steerable tool may incorporate an Inertial Measurement Unit 20 and is connected to a drill bit 21.

Figure 5:
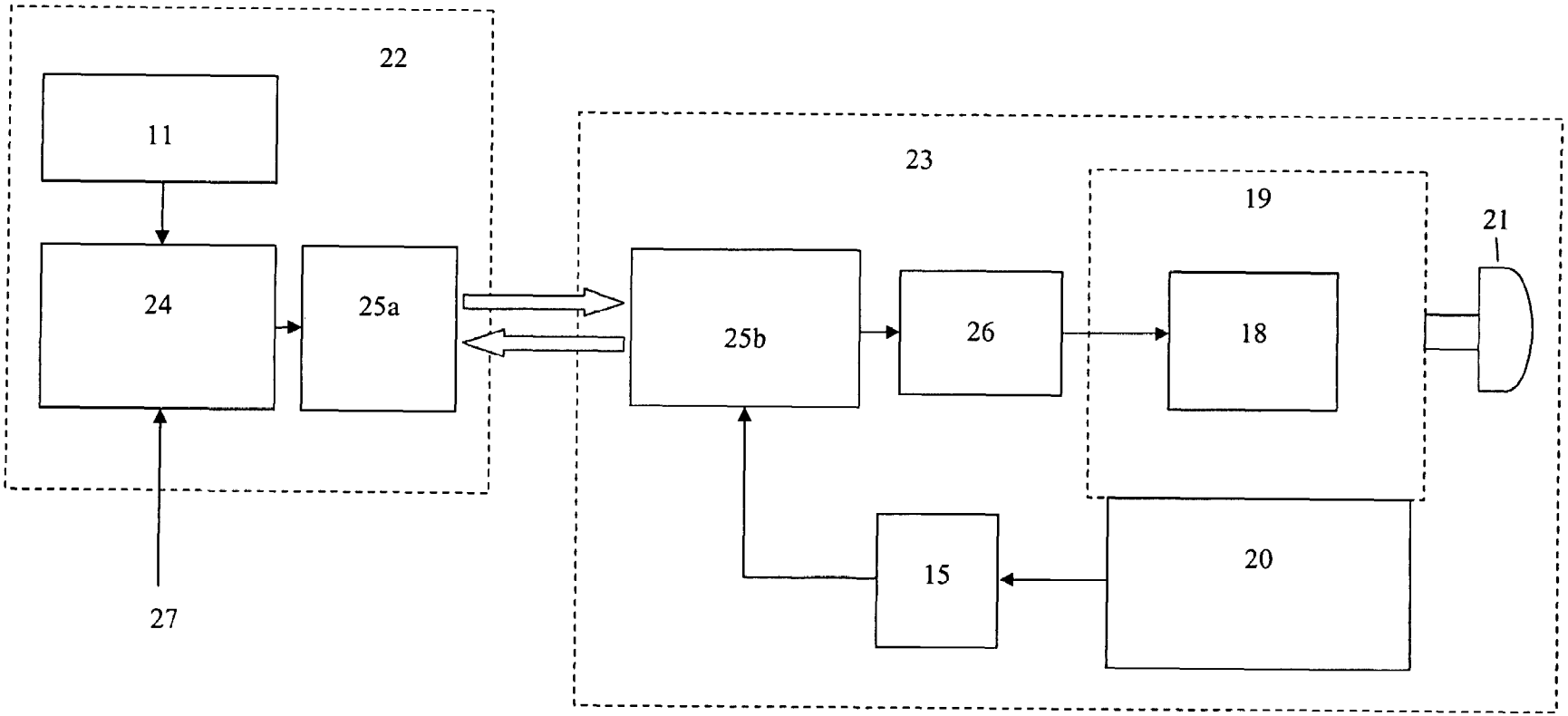
FIG. 5 shows how steering commands are generated in a surface control system with possible manual intervention, according to some embodiments of the invention.

FIG. 5 shows how steering commands are generated in a surface control system with possible manual intervention, according to some embodiments of the invention. FIG. 5 shows a system in some embodiments of the invention in which the closed loop control system is located on the surface in a surface unit 22. In FIG. 5, features which correspond to those shown in FIG. 4 are referenced with like numerals. The additional features are a down hole unit 23, a surface control unit 24, a two-way communications link 25, a drive unit 26 and operator interface 27. The provision of the closed loop control system at the surface allows for possible operator intervention in circumstances where this is necessary. For example, if problems are encountered during the automated guidance process and a change of well-bore trajectory is required.

Thus by utilizing an Inertial Measurement System, which provides continuous and accurate information concerning the direction and/or position of the drill bit, and comparing this information with pre-planned well bore trajectory information, a closed loop control system for the automatic guidance of rotary steerable tools is achieved.

In some embodiments in which only direction calculations are used, the estimated inclination and azimuth readings at a given well depth/bore hole path length may be compared with a stored profile of these quantities corresponding to the required well profile. Steering commands may then be generated in proportion to the difference between these estimates. The differences between the desired and estimated inclination and azimuth may be resolved into steering tool axes, using the estimated tool face angle, to form the signals to be passed to the bend unit of the rotary steerable tool.

$$\Delta x^R(d)=\hat{x}^R(d)-x^R(d)$$

In some embodiments in which position calculations are used, the position estimates, which may be generated in a local vertical geographic reference frame, may be compared with the desired trajectory profile specified in the same coordinate frame, as a function of well depth. In vector form:

where $x^R(d)$=reference trajectory position at depth d, specified in reference axes $\hat{x}^R(d)$=estimated position at depth d, specified in reference axes $\Delta x_R(d)$=position error depth d, specified in reference axes The differences between the estimated and desired positions may be transformed into well bore axes using the attitude estimates generated by the inertial measurement unit, to form:

$$\Delta x^W(d) = \begin{bmatrix} \Delta x \\ \Delta y \\ \Delta z \end{bmatrix} = C_R^W(d)\Delta x^R(d)$$

where $C_R^W(d)$=direction cosine matrix relating reference and well bore axes $\Delta x^W(d)$=position error at depth d, specified in well bore axes $\Delta x$, $\Delta y$, $\Delta z$=components of position error The z axis of the well bore coordinate frame (xyz) is coincident with the along-hole axis of the well, and the x and y axes are perpendicular to z and to each other. Steering commands ($\alpha$ and $\beta$) may then be derived as a function of the lateral positional errors specified ($\Delta x$ and $\Delta y$) in well bore axis:

$$\alpha = K_\alpha \Delta x$$

$$\beta = K_\beta \Delta y$$

Other control strategies may be adopted, rather than the simple form shown here. For example, steering signals may be derived taking into account the rates of change of the position error components.

In some embodiments, the closed loop operation may include activation or reaction limits which could be specified or changed as required. This feature would inhibit the response of the control system to small measurement variations, thus suppressing mico-tortuosity in the drilled well path, the objective being to provide a smooth well path to the target location. The activation limit settings may be governed by prevailing drilling conditions and formation effects.

Figure 2:
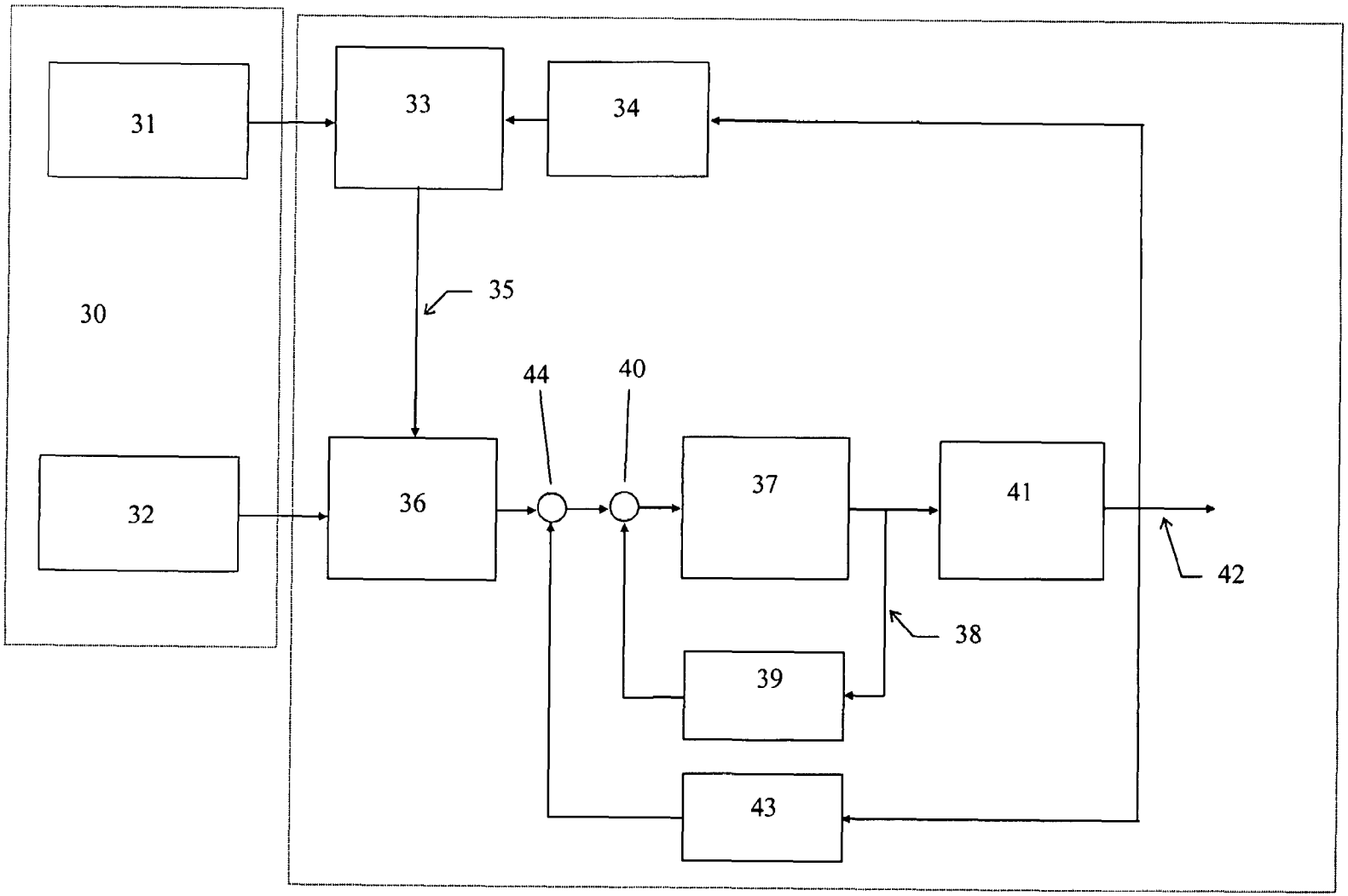
FIG. 2 is a block diagram of an inertial navigation system, according to some embodiments of the invention.

FIG. 2 is a block diagram of an inertial navigation system, according to some embodiments of the invention. The INS is shown here in configuration for drill bit position calculation. FIG. 2 shows the IMU 30 which comprises gyroscopes 31 and accelerometers 32. The measurements taken by the gyroscopes concerning angular rate may be passed to an attitude computation means 33. The attitude computation means may use the angular rate measurements and information concerning the Earth's rate 34 and may compute the attitude of the IMU. This may be output in the form of a direction cosine matrix 35. An acceleration output resolution means 36 may take the acceleration measurement information output from the accelerometers and the direction cosine matrix and may pass this information onto a navigation computation means 37. The navigation computation means may then produce inertial navigation system (INS) velocity estimates 38.

The estimates 38 may be first fed into a Coriolis correction means 39, the output of which is added by means 40 to the input of the navigation computation means forming a first feed back loop. The INS velocity estimates may be second fed into a velocity integration means 41 which produces INS position estimates 42. The position estimates may be first fed into a gravity computation means 43 the output of which is added by means 44 to the input of the navigation computation means forming a second feed back loop. The INS position estimates may also be used to compute the components of Earth's rate which are fed into the attitude computation means. Finally the INS position estimates may be output from the INS to provide positional information.

Figure 3:
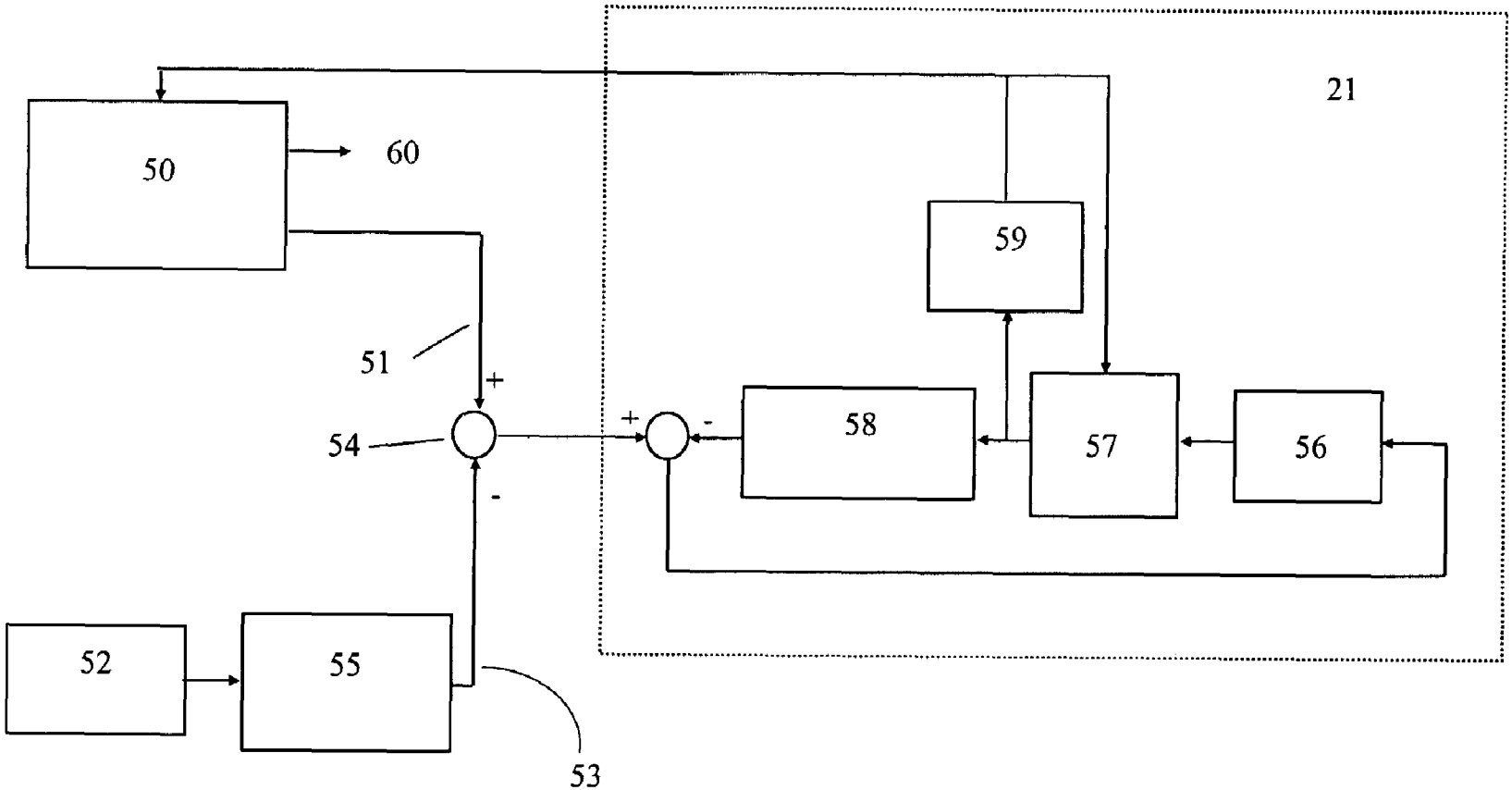
FIG. 3 is a block diagram showing the use of depth information in conjunction with the inertial navigation system, according to some embodiments of the invention.

In order to limit, or bound, the growth of errors in the INS arising as a result of instrument biases and other errors in the sensor measurements, independent measurements of bore hole path length may be used. These measurements may be compared with estimates of the same quantities derived from the INS outputs and used to correct the INS as indicated in FIG. 3. Alternatively, zero velocity updates may be applied at pipe connections when the down hole system is known to be stationary, to achieve a similar effect.

FIG. 3 is a block diagram showing the use of depth information in conjunction with the inertial navigation system, according to some embodiments of the invention. In particular, FIG. 3 shows INS 50 path length estimates 51 being differenced with depth sensor 52 path length estimates 53 by difference means 54. The INS path length estimates may be derived from the INS position estimates and may be received from the INS 50. The depth sensor path length estimates may be derived from a depth sensor 52 and signal processor 55. The difference between the two sets of estimates may then be passed to an error model filter 21 which may be a Kalman filter. The error model filter may first apply a gain to the difference data at gain means 56. The output of the gain means may be fed into an INS error model means 57, the output of which may be fed into a measurement model means 58 and a resent control means 59. The output of the measurement model means may be taken away from the difference data which is initially input into the error mode filter and the resultant signal may be input into the gain means. The output of the resent control means may be input into the INS error model and the INS itself. Thus the INS is able to output a corrected estimate of borehole trajectory 60.

As described above, the IMU provides measurements of acceleration and angular rate about three orthogonal axes. This is typically achieved using three single axis accelerometers and three single axis gyroscopes, the axes of which are mutually orthogonal. Alternatively, the three single axis gyroscopes may be replaced by two dual-axis gyroscopes. While it is often the case that the sensitive axes of the inertial sensors are configured to be perpendicular to one another, this is not essential, and a so-called skewed sensor configuration may be adopted. Provided the sensitive axis of one of accelerometers and one of the gyroscopes does not lie in the same plane as the sensitive axes of the other two accelerometers and gyroscopes respectively, it is possible to compute the required readings about three mutually orthogonal axes.

In addition to the survey data produced by the IMU system described above, other survey data generated by a conventional MWD survey tool located further up the tool string may be used in correlation with the IMU calculations. This data would provide additional survey checks and an increased confidence in the calculated well path position.

In the description, numerous specific details such as logic implementations, opcodes, means to specify operands, resource partitioning/sharing/duplication implementations, types and interrelationships of system components, and logic partitioning/integration choices are set forth in order to provide a more thorough understanding of the present invention. It will be appreciated, however, by one skilled in the art that embodiments of the invention may be practiced without such specific details. Those of ordinary skill in the art, with the included descriptions will be able to implement appropriate functionality without undue experimentation.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

In view of the wide variety of permutations to the embodiments described herein, this detailed description is intended to be illustrative only, and should not be taken as limiting the scope of the invention. What is claimed as the invention, therefore, is all such modifications as may come within the scope and spirit of the following claims and equivalents thereto. Therefore, the specification and drawings are to be regarded in an illustrative rather than a restrictive sense.

What is claimed is:

1. An apparatus comprising:

a rotary steerable tool having a main tool body having a first end coupled to a bottom hole assembly of a drill string and a second send coupled to a drill bit, the rotary steerable tool comprising an inertial measurement unit to output a measurement used to determine an azimuthal deviation and inclination of the rotary steerable tool during a drilling operation, wherein the rotary steerable tool comprises a shaft comprising a rotating platform on which said inertial measurement unit is positioned.

2. The apparatus of claim 1, wherein the measurement includes an angular rate around a number of orthogonal axes.

3. The apparatus of claim 2, wherein the measurement includes a linear acceleration along the number of orthogonal axes.

4. The apparatus of claim 1, wherein the main tool body includes an outer housing, wherein the inertial measurement unit is positioned in the outer housing.

5. The apparatus of claim 1, wherein the inertial measurement unit is to output the measurement independent of a magnetometer measurement.

6. The apparatus of claim 1, wherein the inertial measurement unit is to output the measurement that includes a magnetometer measurement.

7. The apparatus of claim 1, wherein the steerable well bore drilling tool further comprises an estimation means to estimate a direction of the steerable well bore drilling tool based on an output from the inertial measurement unit.

8. The apparatus of claim 7, wherein the inertial measurement unit includes at least one gyroscope to measure angular rate around one or more of the number of orthogonal axes.

9. The apparatus of claim 8, wherein the inertial measurement unit includes at least one accelerometer to measure acceleration along one or more of the number of orthogonal axes.

10. The apparatus of claim 9, wherein the inertial measurement unit includes an orthogonal triad of linear accelerometers and two dual-axis gyroscopes.

11. The apparatus of claim 9, wherein the steerable well bore drilling tool further comprises a bore hole length measurement means to measure the distance of the steerable well bore drilling tool along the bore hole.

12. The apparatus of claim 11, wherein the estimation means is to estimate the azimuthal deviation and the inclination of the main tool body based on the angular rate and the acceleration and as a function of the length of the bore hole.

13. The apparatus of claim 1, further comprising a surface unit comprising a control means to control a direction of the rotary steerable tool for the drilling operation using the azimuthal deviation and the inclination.

14. An apparatus comprising:

a rotary steerable tool comprising a main tool body having a first end connectable to a drill string and a second end connectable to a drill bit, the tool body arranged to transmit rotary motion from said first end to said second end, the main tool body comprising:

an outer housing:

a flexible shaft having a first end and a second end corresponding to said first and second ends of said main tool body wherein said first end of said shaft is connectable to a said drill string and said second end of said shaft is connectable to a said drill bit, the flexible shaft arranged to transmit rotary motion from said first end to said second end of the flexible shaft, wherein the flexible shaft is positioned in the outer housing:

deflection means arranged to deflect said second end away from a longitudinal axis of the main tool body, wherein said deflection means is a flexible shaft deflection means arranged to deflect said second end of said shaft away from said longitudinal axis of said main tool body;

an inertial measurement unit positioned within said outer housing and at said second end of said main tool body;

estimation means arranged to first estimate the direction of the main tool body on the basis of the output of said inertial measurement unit; and control means first arranged to calculate the difference between the estimated direction and corresponding pre-stored direction information and second arranged to control said deflection means so as to deflect said second end on the basis of said difference.

15. The apparatus of claim 14, wherein said drill string further comprises a bottom hole assembly to which said main tool body first end is connectable.

16. The apparatus of claims 14, wherein said drilling tool system configuration further comprises a surface unit comprising said control means.

17. The apparatus of claim 16, wherein said drilling tool further comprises a communication means arranged to enable two-way communications between said main tool body and said surface unit.

18. The apparatus of claim 14, wherein said shaft has a first end and a second end corresponding to said first and second ends of said main tool body.

19. The apparatus of claim 18, wherein said first end of said shaft is connectable to a said drill string and said second end of said shaft is connectable to a said drill bit.

20. The apparatus of claim 14, wherein said main body further comprises a further shaft positioned between said drill string and said flexible shaft.

21. The apparatus of claim 20, wherein said inertial measurement unit is positioned within said further shaft.

22. The apparatus of claim 21, wherein said further shaft comprises a rotating platform on which said inertial measurement unit is positioned.

23. The apparatus of claim 22, wherein said platform comprises drive means which is arranged to rotate the platform so as to control the angular displacement of the platform with respect to an Earth fixed reference frame.

24. The apparatus of claim 14, wherein said inertial measurement unit comprises at least one gyroscope and at least one accelerometer.

25. The tool of claim 24, wherein said gyroscopes are arranged to measure angular rate around a plurality of orthogonal axes and said accelerometers are arranged to measure specific force acceleration along a plurality of orthogonal axes.

26. The apparatus of claim 25, wherein said inertial measurement unit comprises an orthogonal triad of linear accelerometers and two dual-axis gyroscopes.

27. The apparatus of claim 26, further comprising bore hole length measurement means arranged to measure the distance of said steerable drilling tool along said bore hole.

28. The apparatus of claim 27, wherein said estimation means is further arranged to estimate the inclination and azimuthal deviation of said main tool body, on the basis of said measurements of angular rate and acceleration and as a function of bore hole length.

29. The apparatus of claim 28, wherein said corresponding pre-stored direction information comprises pre-planned borehole inclination and azimuthal deviation parameters as a function of bore hole length.

30. The apparatus of claim 29, wherein said difference means is further arranged to calculate the difference between the estimated inclination and azimuthal deviation of the bore hole at a given bore hole length and the pre-planned inclination and azimuthal deviation parameters at a corresponding bore hole length.

31. The apparatus of claim 30, wherein said estimation means is second arranged to estimate the position of the main tool body on the basis of the output of said inertial measurement unit.

32. The apparatus of claim 31, wherein said control means is third arranged to calculate the difference between the estimated position and corresponding pre-stored position information and forth arranged to control said deflection means so as to deflect said second end on the basis of said difference between the estimated position and corresponding pre-stored position information.

33. The apparatus of claim 32, wherein said pre-stored position information comprises pre-planned borehole position parameters as a function of bore hole length.

34. The apparatus of claim 33, wherein said difference means is further arranged to calculate the difference between the estimated position of the bore hole at a given bore hole length and the pre-planned position parameters at a corresponding bore hole length.

35. A system comprising:

a drill string;

a drill bit; and a rotary steerable drilling tool comprising, a main tool body having a first end coupled to the drill string and a second end coupled to the drill bit, wherein the main tool body comprises a flexible shaft and a non-flexible shaft, wherein the rotary steerable drilling tool is positioned in the non-flexible shaft; and an inertial measurement unit to output a measurement that includes an angular rate around a number of orthogonal axes and a linear acceleration along the number of orthogonal axes, wherein the measurement is used to determine an angular orientation of the rotary steerable drilling tool during a drilling operation.

36. The system of claim 35, wherein the angular orientation includes an azimuthal deviation and inclination of the rotary steerable drilling tool.

37. The system of claim 35, wherein the main tool body comprises a deflection means to deflect the second end away from a longitudinal axis of the main tool body.

38. The system of claim 37, wherein the main tool body comprises an estimation means to estimate a direction of the main tool body based on the measurement output by the inertial measurement unit.

39. The system of claim 38, further comprising a surface unit having a control means to calculate a difference between the estimated direction and corresponding pre-stored direction information, wherein the control means is to control the deflection means based on the difference.

40. The system of claim 35, wherein a first end of the flexible shaft is coupled to the drill string and a second end of the flexible shaft is coupled to the drill bit, wherein the flexible shaft is to transmit a rotary motion from the first end to the second end.

41. The system of claim 35, wherein the inertial measurement unit is to output the measurement independent of a magnetometer measurement.

42. The system of claim 35, wherein the inertial measurement unit is to output the measurement that includes a magnetometer measurement.

43. A method comprising:

steering a direction of drilling of a borehole using a rotary steerable tool that comprises a shaft comprising a rotating platform, wherein the steering comprises, receiving a measurement of an angular rate around a number of orthogonal axes from an inertial measurement unit that is positioned on the rotating platform of the shaft of the rotary steerable tool;

receiving a measurement of an acceleration along the number of orthogonal axes from the inertial measurement unit; and estimating an inclination and an azimuthal direction of a main tool body of the rotary steerable tool based on the measurement of the angular rate and the measurement of the acceleration.

44. The method of claim 43, wherein steering the direction further comprises determining a difference between the estimated inclination and the azimuthal direction and a corresponding pre-stored inclination and azimuthal direction.

45. The method of claim 44, further comprising controlling a deflection of an end of the main tool body that is coupled to a drill bit based on the difference.

46. The method of claim 43, further comprising receiving a control direction from a surface unit, wherein steering the direction of the drilling is based on the control direction from the surface unit.

47. An apparatus comprising:

a rotary steerable tool having a main tool body having a first end coupled to a bottom hole assembly of a drill string and a second send coupled to a drill bit, the rotary steerable tool comprising an inertial measurement unit to output a measurement used to determine an azimuthal deviation and inclination of the rotary steerable tool during a drilling operation, wherein the rotary steerable tool comprises an estimation means to estimate a direction of the steerable well bore drilling tool based on an output from the inertial measurement unit, the inertial measurement unit including at least one gyroscope to measure angular rate around one or more of the number of orthogonal axes and including at least one accelerometer to measure acceleration along one or more of the number of orthogonal axes, wherein the rotary steerable tool comprises a bore hole length measurement means to measure the distance of the steerable well bore drilling tool along the bore hole, and wherein the estimation means is to estimate the azimuthal deviation and the inclination of the main tool body based on the angular rate and the acceleration and as a function of the length of the bore hole.

48. The apparatus of claim 47, wherein the inertial measurement unit includes an orthogonal triad of linear accelerometers and two dual-axis gyroscopes.

49. The apparatus of claim 47, wherein the measurement includes a linear acceleration along the number of orthogonal axes.

50. The apparatus of claim 47, wherein the main tool body includes an outer housing, wherein the inertial measurement unit is positioned in the outer housing.

51. The apparatus of claim 47, wherein the inertial measurement unit is to output the measurement independent of a magnetometer measurement.

52. The apparatus of claim 47, wherein the inertial measurement unit is to output the measurement that includes a magnetometer measurement.

* * * * *

UNITED STATES PATENT AND TRADEMARK OFFICE

CERTIFICATE OF CORRECTION

PATENT NO. : 7,506,696 B2
APPLICATION NO. : 10/980645
DATED : March 24, 2009
INVENTOR(S) : John L. Weston et al.

It is certified that error appears in the above-identified patent and that said Letters Patent is hereby corrected as shown below:

In column 9, line 25, in Claim 1, delete "send" and insert -- end --, therefor.

In column 10, line 11, in Claim 14, delete "housing:" and insert -- housing; --, therefor.

In column 10, line 20, in Claim 14, delete "housing:" and insert -- housing; --, therefor.

In column 10, line 42, in Claim 16, delete "claims" and insert -- claim --, therefor.

In column 11, line 38, in Claim 32, delete "forth" and insert -- fourth --, therefor.

In column 12, line 56, in Claim 47, delete "send" and insert -- end --, therefor.

Signed and Sealed this

Fourteenth Day of September, 2010

David J. Kappos

David J. Kappos
*Director of the United States Patent and Trademark Office*